US006988564B2

(12) United States Patent
White

(10) Patent No.: US 6,988,564 B2
(45) Date of Patent: Jan. 24, 2006

(54) DIESEL HAMMER SYSTEMS AND METHODS

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 10/848,798

(22) Filed: May 18, 2004

(65) Prior Publication Data

US 2005/0000712 A1 Jan. 6, 2005

Related U.S. Application Data

(63) Continuation of application No. 10/124,201, filed on Apr. 16, 2002, now Pat. No. 6,736,218.

(60) Provisional application No. 60/284,180, filed on Apr. 16, 2001.

(51) Int. Cl.
*E02D 7/12* (2006.01)

(52) U.S. Cl. ..... 173/135; 173/137; 173/206

(58) Field of Classification Search ..... 173/135–137, 173/206, 19, 20, 207; 123/46 SC, 46 H
See application file for complete search history.

(56) References Cited

U.S. PATENT DOCUMENTS 3,679,005 A * 7/1972 Inaba et al. ..... 173/137
3,822,969 A 7/1974 Kummel
3,967,688 A 7/1976 Inenaga et al.
4,109,475 A * 8/1978 Schnell ..... 123/46 H
6,102,133 A 8/2000 Scheid et al.
6,736,218 B1 * 5/2004 White ..... 173/137

OTHER PUBLICATIONS

ICE; "Diesel Pile Hammers" brochure; publication date unknown, USA.
Portions of Operations Manual for Diesel Hammers Depicting the Basic Operation of Diesel Hammers and Fuel Pumps Used by Commercially Available Diesel Hammers (8 pages).

* cited by examiner

*Primary Examiner*—Scott A. Smith
(74) *Attorney, Agent, or Firm*—Michael R. Schacht; Schacht Law Office, Inc

(57) ABSTRACT

A diesel hammer system for driving a pile, comprising a housing, an anvil member supported by the housing, a clamp assembly adapted to connect the anvil member to the pile, and a ram member disposed within the housing. A fuel pump system injects fuel into a combustion chamber defined by the housing, anvil member, and the ram member. A coupling system detachably engages the ram member to raise the ram member from an impact position to an upper position, the coupling system comprising a trigger member that, when engaged, causes the coupling system to release the ram member. A trigger projection mounted is on the housing to engage the trigger member to cause the coupling system to release the ram member at the upper position. The diesel hammer further comprises a pre-trigger system comprising a pre-trigger member movable between an extended position and a retracted position.

10 Claims, 10 Drawing Sheets

20
22
30
32
34
36
38
40
42
44
46
50
52
54
56
60
62
70
A

DIESEL HAMMER SYSTEMS AND METHODS

RELATED APPLICATIONS

This is a continuation of U.S. patent application Ser. No. 10/124,201 filed Apr. 16, 2002, now U.S. Pat. No. 6,736,218, which claims priority of U.S. Provisional Patent Application Ser. No. 60/284,180, which was filed on Apr. 16, 2001.

TECHNICAL FIELD

The present invention relates to methods and apparatus for inserting elongate members into the earth and, more particularly, to diesel hammers that create pile driving forces by combusting diesel fuel.

BACKGROUND OF THE INVENTION

For certain construction projects, elongate members such as piles, anchor members, caissons, and mandrels for inserting wick drain material must be placed into the earth. It is well-known that such rigid members may often be driven into the earth without prior excavation. The term "piles" will be used herein to refer to the elongate rigid members typically driven into the earth.

One system for driving piles is conventionally referred to as a diesel ram for driving the pile and as a piston for compressing diesel fuel. Diesel fuel is injected into a combustion chamber below the ram member as the ram member drops. The dropping ram member engages an anvil member that transfers the load of the ram member to the pile to drive the pile. At the same time, the diesel fuel ignites, forcing the ram member and the anvil member in opposite directions. The anvil member further drives the pile, while the ram member begins a new combustion cycle.

An important factor in the operation of a diesel hammer is the quantity of diesel fuel injected into the combustion chamber because the ignition of the diesel fuel directly determines the driving forces applied to the pile. In particular, the quantity of diesel fuel determines both the forces on the anvil member both at the point of ignition and, because it affects how high the ram member goes, when the ram member impacts the anvil member on the compression stroke prior to ignition.

Conventional diesel hammers employ a variable fuel pump having a fuel chamber, a control pulley, and a control rope. The fuel chamber stores the fuel to be delivered to the combustion chamber. The angular orientation of the control pulley determines the effective volume of the fuel chamber. The control rope extends partly around the control pulley such that pulling on either end of the control rope causes the control pulley to rotate and change its angular orientation. Conventional variable fuel pumps require an operator to stand on the ground adjacent to the diesel hammer and pull the control rope to adjust the effective volume of the fuel chamber. The process of adjusting the amount of fuel delivered to the combustion chamber is thus cumbersome and conventional variable fuel pumps are typically placed in one setting and left there during the driving process.

The need thus exists for improved variable fuel pumps for diesel hammers.

RELATED ART

Submitted herewith are portions of operations manuals for diesel hammers depicting the basic operation of diesel hammers and the fuel pumps used by commercially available diesel hammers. These references employ a control rope and control pulley to change the amount of fuel delivered to the combustion chamber as generally described in the BACKGROUND section of this application.

SUMMARY OF THE INVENTION

The present invention may be embodied as a diesel hammer system for driving a pile. The diesel hammer system comprises a housing, an anvil member supported by the housing, a clamp assembly adapted to connect the anvil member to the pile, and a ram member disposed within the housing. A fuel pump system injects fuel into a combustion chamber defined by the housing, anvil member, and the ram member. A coupling system detachably engages the ram member to raise the ram member from an impact position to an upper position, the coupling system comprising a trigger member that, when engaged, causes the coupling system to release, the ram member. A trigger projection mounted is on the housing to engage the trigger member to cause the coupling system to release the ram member at the upper position.

The diesel hammer further comprises a pre-trigger system comprising a pre-trigger member movable between an extended position and a retracted position. When the pre-trigger member is in the extended position, the pre-trigger member engages the trigger member as the ram member moves from the impact position towards the upper position to cause the coupling system to release the ram member at a pre-trigger position. When the pre-trigger member is in the retracted position, the pre-trigger member does not engage the trigger member as the ram member moves from the impact position to the upper position.

When the pre-trigger member is in the retracted position, the ram member moves from the impact position to the upper position and back to the impact position such that the ram member acts on the pump piston through the pump lever to force fuel out of the fuel chamber and into the combustion chamber. When the pre-trigger member is in the extended position, movement of the ram member from the impact position to the pre-trigger position and back to the impact position does not cause fuel to be forced out of the fuel chamber and into the combustion chamber.

DETAILED DESCRIPTION OF THE INVENTION

Figures 1A, 1B, 1C, 1D, 1E:
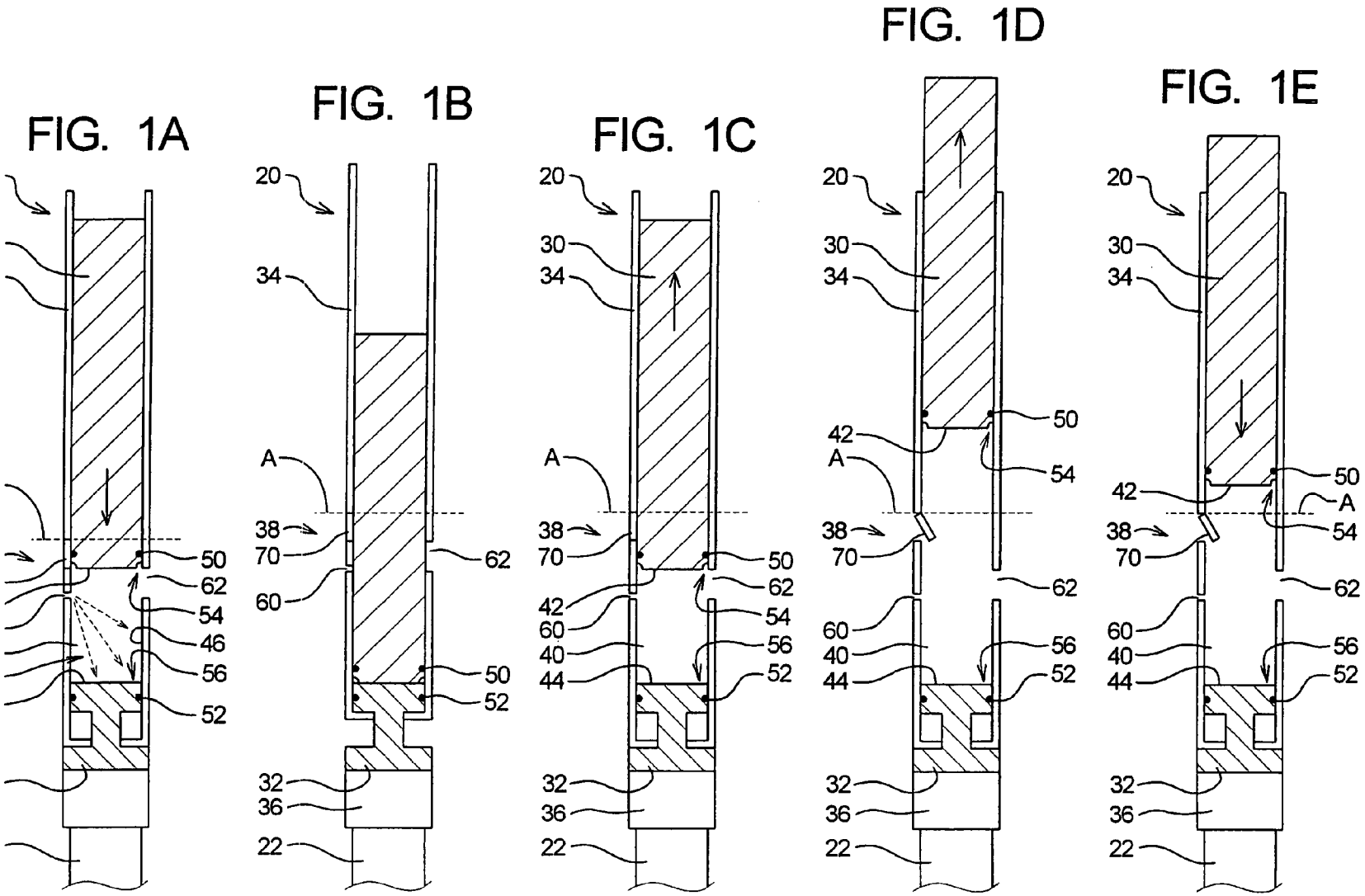
FIGS. 1A–1E are somewhat schematic sectional views of a diesel hammer depicting the basic combustion/drive cycle thereof.

The first section of the following discussion will describe the basic construction and operation of diesel hammer pile driving systems. The next section will contain will be a more detailed discussion of prior art variable fuel pumps. The following section will contain a discussion of the variable fuel pump of the present invention.

I. Construction and Operation of Conventional Diesel Hammer

Turning to the drawing, depicted at 20 in FIGS. 1A–1E is a diesel hammer system that may use a variable fuel pump constructed in accordance with, and embodying, the principles of the present invention. The diesel hammer system 20 is designed to insert a pile 22 into the ground. The diesel hammer system 20 will include a spotter, crane, or other equipment as necessary to hold the hammer system 20 in a desired orientation with respect to the ground. Such structural components of the hammer system 20 are conventional and will not be described herein.

The diesel hammer system 20 comprises a ram member 30, an anvil member 32, a housing member 34, a clamp assembly 36, and a fuel pump system 38. The ram member 30 is guided by the housing member 34 for movement between a lower position (FIG. 1B) and an upper position (FIG. 1D). The anvil member 32 is guided by the housing member 34 for movement between a rest position (FIG. 1A) and an impact position (FIG. 1B). The anvil member 32 is rigidly connected to the clamp assembly 36. The clamp assembly 36 is detachably fixed relative to the pile 22.

A combustion chamber 40 is formed within the housing member 34 between a lower surface 42 of the ram member 30 and an upper surface 44 of the anvil member 32. Seals 50 and 52 are arranged in gaps 54 and 56 between an inner surface 46 of the housing member 34 and the ram and anvil members 30 and 32, respectively. When the seals 50 and 52 function properly, fluid is substantially prevented from flowing out of the combustion chamber 40 through these gaps 54 and 56.

A fuel port 60 and an exhaust port 62 are formed in the housing member 34. The fuel port 60 is arranged to allow the fuel pump system 38 to inject fuel into the combustion chamber 40. The exhaust port 62 is arranged to allow exhaust gasses to be expelled from the combustion chamber 40 and to allow air to be drawn into the chamber 40.

The fuel pump system 38 comprises a pump lever 70. The pump lever 70 is biased into a ready position in which at least a portion of the pump lever 70 is within the housing member 34 (FIGS. 1D and 1E). When the ram member 30 drops below a trigger point A, the ram member 30 engages the pump lever 70 and moves the pump lever 70 from the ready position into a pump position (FIGS. 1A–1C). Forcing the pump lever 70 from the ready position into the pump position causes diesel fuel to be injected into the combustion chamber 40 through the fuel port 60.

The diesel hammer system 20 operates in a combustion cycle that will now be described with reference to FIG. 1. Referring initially to FIG. 1A, the hammer system 20 is shown in a pump state in which the ram member 30 is dropping and has forced the pump lever 70 from the ready position (FIGS. 1D and 1F) into the pump position (FIGS. 1A–1C). When the pump lever is forced from the ready position into the pump position, diesel fuel is injected as shown at 72 through the fuel port 60 into the combustion chamber 40 where it is mixed with air.

As the combustion cycle continues, the ram member 30 drops to a level where both the fuel port 60 and exhaust port 62 are covered by the ram member 30. At this point, the combustion chamber 40 is effectively sealed, and continued dropping of the ram member 30 compresses the air/fuel mixture within the combustion chamber 40.

Referring now to FIG. 1B, the hammer system 20 is shown in an impact state in which the lower surface 42 of the ram member 30 contacts the upper surface 44 of the anvil member 32. In the impact state, the ram member 30 drives the anvil member 32 towards the pile 22 relative to the housing member 34 as shown by a comparison of FIGS. 1A and 1B. The anvil member 32 thus drives the pile 22 downward through the clamp assembly 36. In addition, the housing member 34 will immediately fall onto the anvil member 32, thereby applying additional driving forces onto the pile member 22.

When the system 20 is in the impact state, the diesel fuel within the combustion chamber 40 ignites in the highly compressed air. The explosion resulting from the ignition of the air/fuel mixture forces the ram member 30 up and the anvil member 32 down. This explosion thus further drives the pile member 22 into the ground.

After the ignition occurs, the anvil member 32 is raised to an upper position as shown in FIG. 1C. As the anvil member 32 moves into the upper position, the lower end of the ram member 30 passes the fuel and exhaust ports 60 and 62. Expanding exhaust gasses are thus forced out of the combustion chamber 40 through the exhaust port 62.

As the ram member continues on to its upper position, fresh air is drawn into the combustion chamber 40 through the exhaust port 62. In addition, the ram member 30 disengages from the pump lever 70. As soon as the ram member 30 disengages from the pump lever, the bias on the pump lever 70 returns the pump lever 70 to the ready position from the pump position and the fuel system 38 readies another quantity of fuel for the next cycle.

After the ram member 30 reaches the upper position as shown in FIG. 1D, the ram member 30 is allowed to drop again. The system 20 then enters a pre-injection state as shown in FIG. 1E. In the pre-injection state, the combustion chamber 40 is filled with fresh air and the fuel pump system 38 is primed to deliver another quantity of fuel. As the ram member 30 continues to drop, the system 20 enters the pump state as described with reference to FIG. 1A and the cycle begins again.

Figure 2:
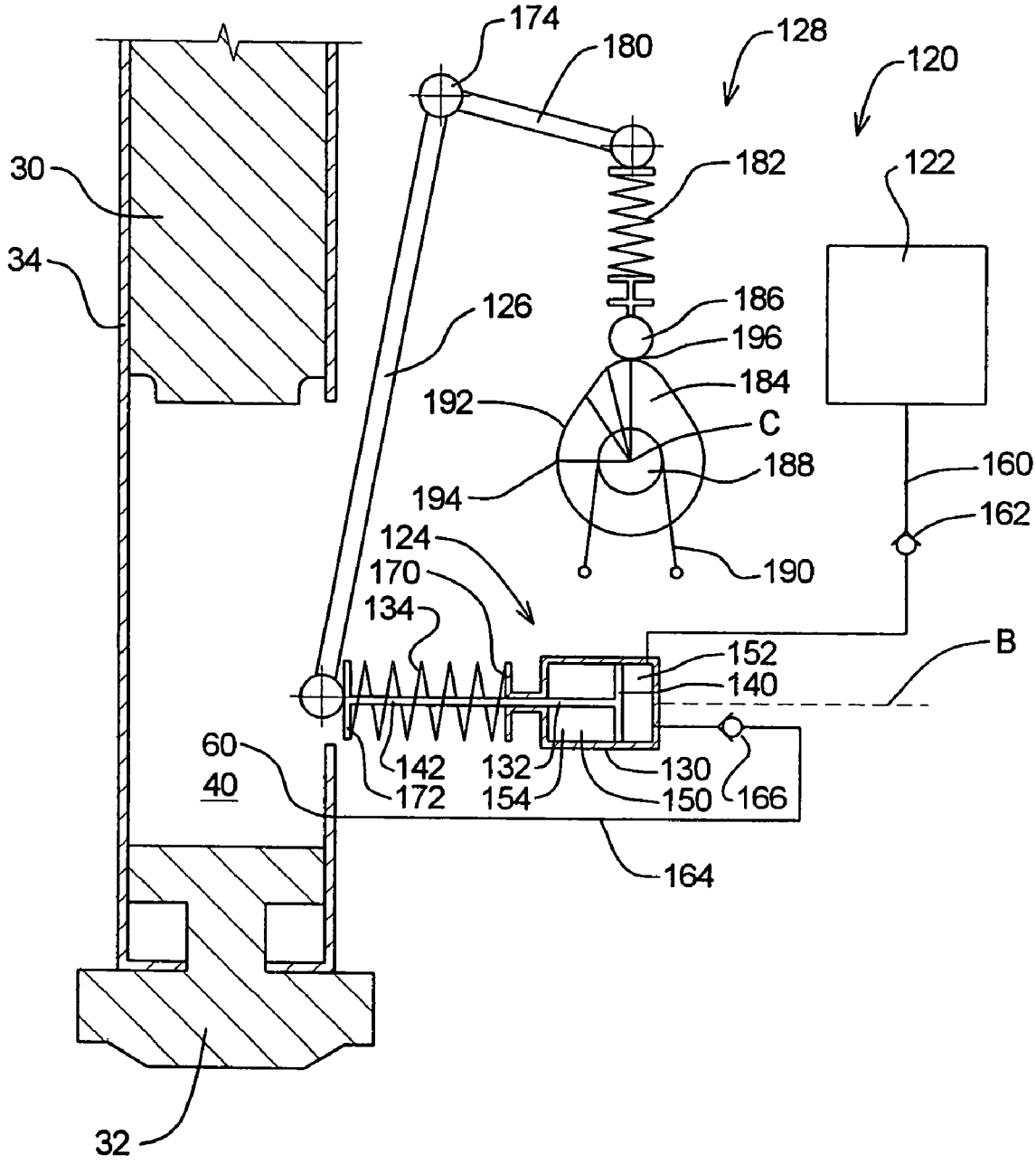
FIG. 2 PRIOR ART
FIGS. 2–4 are part sectional/part schematic views depicting the operation of prior art variable fuel pumps employed by conventional diesel hammers.
Figure 3:
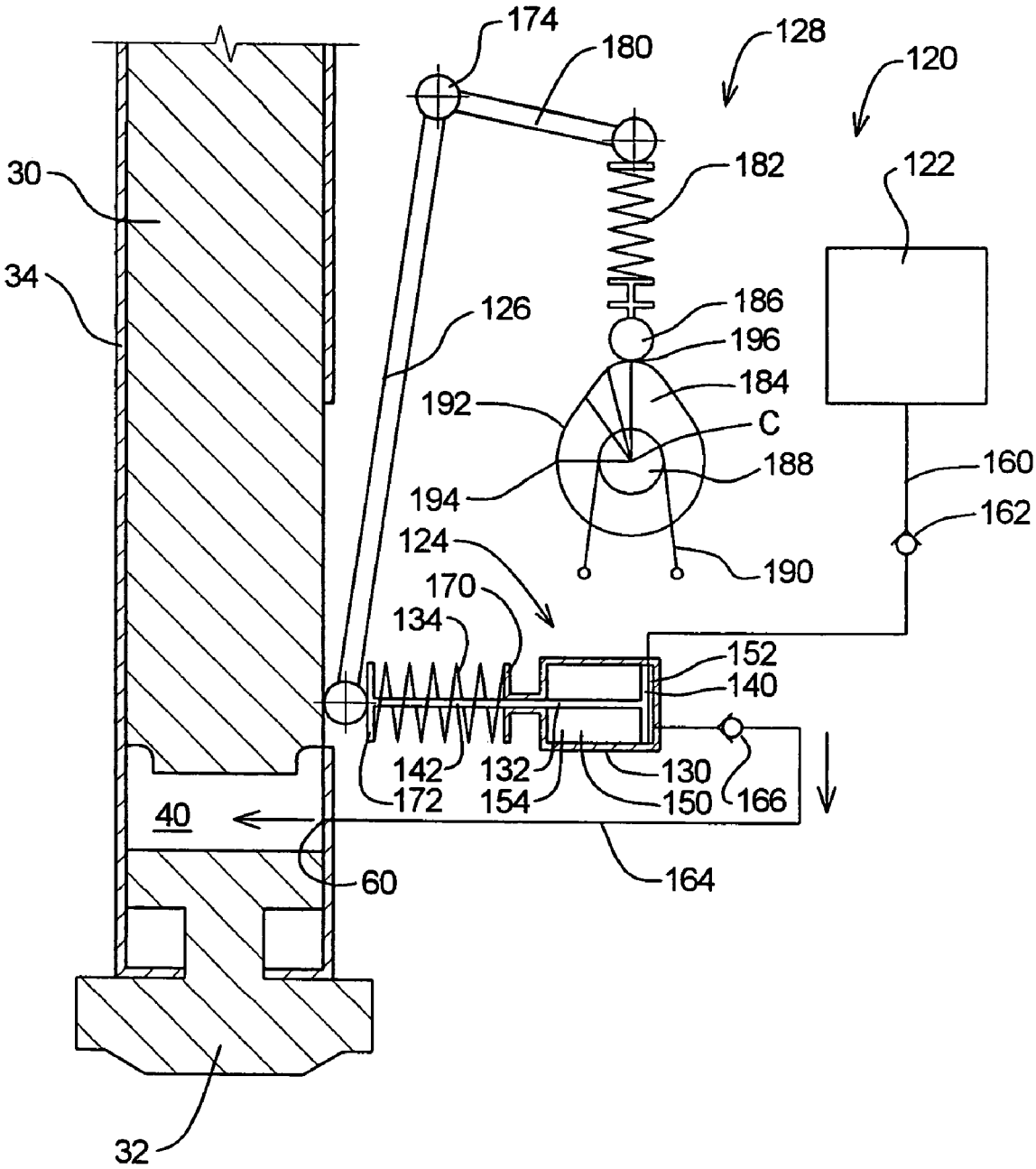
FIG. 3 PRIOR ART
Figure 4:
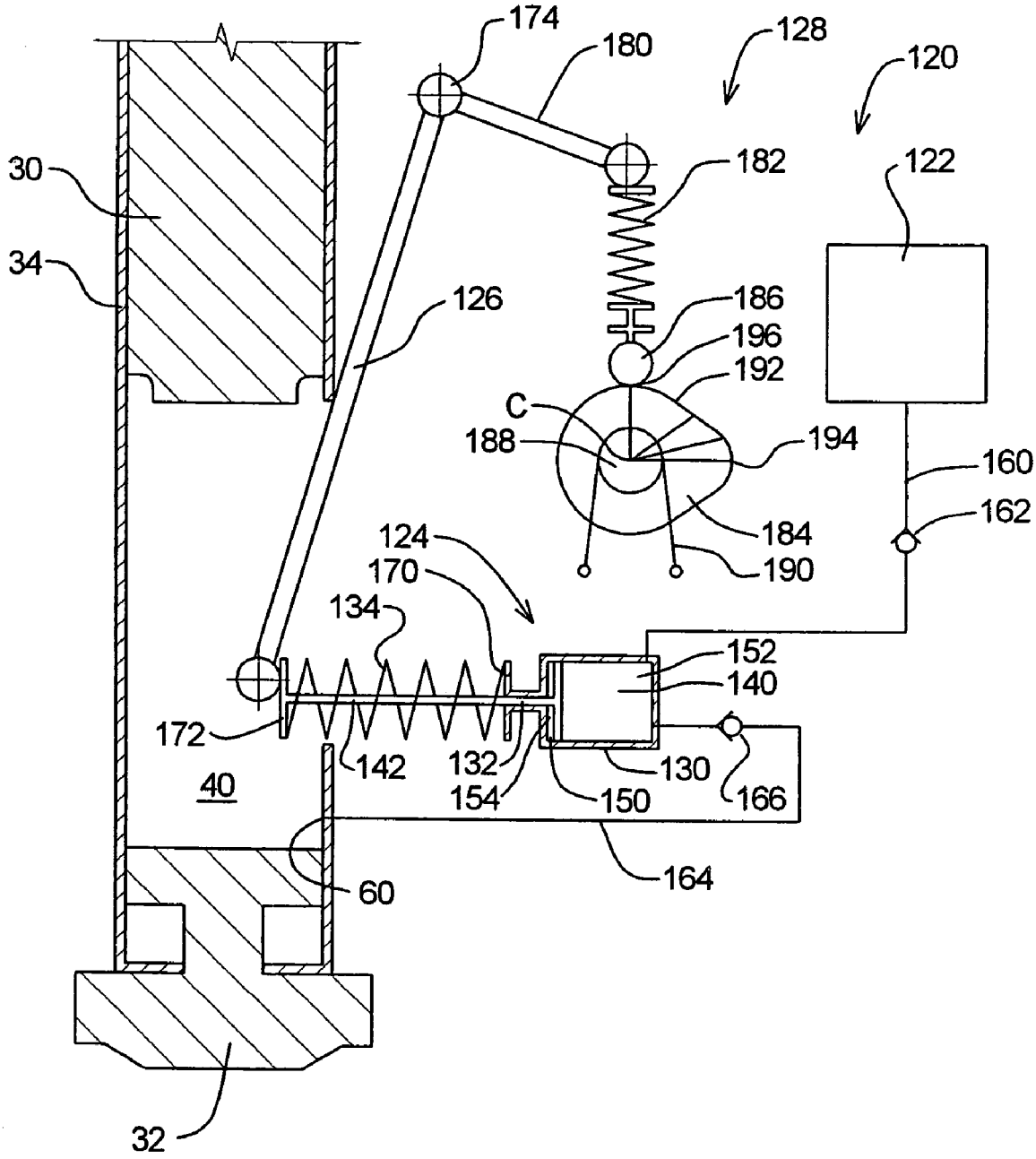
FIG. 4 PRIOR ART

Referring now to FIGS. 2–4, depicted at 120 therein is a prior art variable fuel pump system that may be used as the fuel pump system 38 described above. In particular, the fuel pump system 120 comprises a source 122 of fuel, a fuel pump cylinder assembly 124, a fuel pump lever 126, and a travel limiting assembly 128. The pump lever 126 is used as the pump lever 70 described above.

The fuel pump cylinder assembly 124 comprises a fuel pump housing 130, a piston 132, and a pump spring 134. The fuel pump housing 130 defines a longitudinal axis B. The piston 132 comprises a piston head 140 and a piston shaft 142. The axis of the piston shaft 142 is aligned with the housing axis B such that the piston 132 moves along the housing axis B.

The fuel pump housing 130 defines a fuel pump chamber 150, and the piston head 140 divides the fuel pump chamber 150 into a fuel portion 152 and a reserve portion 154. A seal (not shown) prevents the flow of fluid between the fuel portion 152 and reserve portion 154.

The fuel source 122 is connected through a first conduit 160 to the fuel portion 152 of the fuel pump chamber 150. A first check valve 162 arranged in the first conduit 160 allows fluid to flow only from the source 122 to the fuel pump chamber 150. The fuel portion 152 of the fuel pump chamber 150 is also connected by a second conduit 164 to the fuel port 60 in the housing member 34. A second check valve 166 arranged in the second conduit 164 allows fluid to flow only from the fuel pump chamber 150 to the fuel port 60.

A spring landing 170 is formed on the fuel pump housing 130, and a spring retainer 172 is formed on the piston shaft 142. The pump spring 134 is a compression spring arranged between the spring landing 170 and the spring retainer 172. The pump spring 134 thus biases the spring retainer 172 away from the spring landing 170.

The fuel pump lever 126 is pivotably connected at one end to a pivot point 174 on the housing member 34. The pump lever 126 thus rotates between the ready (FIGS. 2 and 3) and pump (FIG. 3) positions relative to the housing member 34. The other end of the fuel pump lever 126 held against the piston shaft 142 by the travel limiting assembly 128 as will be described in detail below.

Accordingly, rotational movement of the fuel pump lever 126 about the pivot point 174 is translated into displacement of the piston 132 along the housing axis B. In particular, clockwise rotation of the fuel pump lever 126 causes the pump head 140 to move within the pump chamber 150 to decrease the volume of the fuel portion 152 thereof, while counter-clockwise rotation of the fuel pump lever 126 allows the pump spring 134 to move the pump head 140 in the opposite direction, thereby increasing the volume of the fuel portion 152 of the pump chamber 150. The pump spring 134 thus assists movement of the fuel pump lever 126 in the clockwise direction and opposes movement of the fuel pump lever 126 in the counter-clockwise direction.

A comparison of FIGS. 2 and 3 shows that the descending ram member 30 engages the pump lever 126 to rotate this lever in the counter-clockwise direction against the force of the pump spring 134. As shown in FIG. 2, the descending ram member 30 thus indirectly forces any fluid within the fuel portion 152 of the pump chamber 150 out of the pump chamber 150 and into the combustion chamber 40 through the fuel port 60.

Further, as shown in FIG. 3, when the ram member 30 moves above the pump lever 126, the pump lever 126 returns to the ready position under the force of the pump spring 134. The movement of the piston head 140 as the pump lever 134 returns to the ready position draws fuel from the fuel source 122 to refill the fuel portion 152 of the pump chamber 150.

The amount of fuel delivered by the variable fuel pump system 120 is determined by the volume of the fuel portion 152 of the pump chamber 150. The travel limiting assembly 128 is used to adjust the angular position of the pump lever 126 when the lever 126 is in the ready position. Because the pump lever 126 is connected to the piston 132 as described above, the travel limiting assembly 128 thus determines the volume of the fuel portion 152.

The travel limiting assembly 128 comprises a link arm 180, a link spring 182, a cam member 184, a cam roller 186, a control pulley 188, and a control rope 190. The cam member 184 rotates about a cam axis C. The control pulley 188 is attached to the cam member 184 such that rotation of the pulley 188 causes rotation of the cam member 184 about the cam axis C. The control rope 190 engages the control pulley 188 such that pulling on either end of the control rope 190 causes the control pulley 188 to rotate, which in turn causes the cam member 184 to rotate about the cam axis C.

The cam member 184 is eccentric such that the distance between a cam surface 192 and the cam axis C varies from a first location 194 to a second location 196 on the cam surface 192. The cam roller 186 rides on the cam surface 192 such that the distance between the cam roller 186 and the cam axis C varies with angular rotation of the cam member 184. The cam axis C is fixed relative to the housing member 34; therefor, rotation of the cam member 184 causes the cam roller 186 to move relative to the housing member 34.

The link arm 180 is rigidly connected to the pump lever 126 such that the link arm 180 also rotates about the pivot point 174. The link arm 180 is arranged to apply a force on the cam roller 186 that holds the cam roller 186 against the cam surface 192, with the link spring 182 in compression between the link arm 180 and the cam roller 186.

A comparison of FIGS. 2 and 4 shows that the angular orientation of the cam member 184 determines the angular location of the pump lever 126. With the cam member 184 in a first angular orientation as shown in FIG. 2, the cam roller 186 engages the first location 194 on the cam surface 192. With the cam member 184 in a second angular orientation as shown in FIG. 4, the cam roller 186 engages the second location 196 on the cam surface 192.

The cam roller 186 in turn acts through the link spring 182 and link arm 180 to place the pump lever 126 in a first angular location (FIG. 2) or a second angular location (FIG. 4). As described above, the angular location of the pump lever 126 determines the location of the piston head 142 within the pump chamber 150 and thus the volume of the fuel portion 152 thereof.

The angular position of the cam member 184 thus determines the volume of the fuel portion 152 of the pump chamber 150 when the pump lever 126 is in the ready position; this relationship can be seen by comparing FIGS. 2 and 4.

As described above, pulling the ends of the control rope 190 determines the angular position of the cam member 184; the control rope 190 can thus be used to set the volume of the fuel portion 152 of the pump chamber 150.

Figure 11:
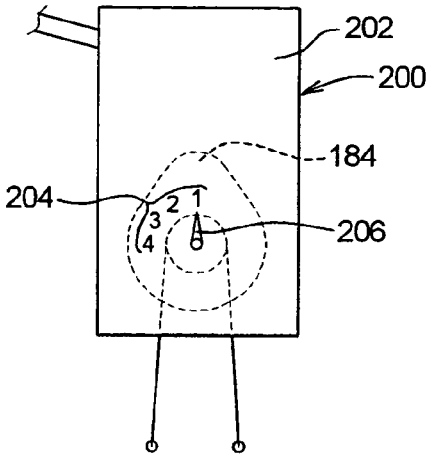
FIG. 11 PRIOR ART
FIG. 11 is a somewhat schematic front elevation view of the prior art fuel pump of FIGS. 2–4.

Referring now to FIG. 11, depicted therein is a schematic view of a housing 200 of the conventional variable fuel pump system 120 described above. The housing 200 has a face 202 on which is formed indicia 204 corresponding to angular positions of the cam member 184. An indicator 206 is rigidly fixed in a predetermined relationship to the cam member 184. The indicator 206 is located outside of the housing 200. As the cam member 184 rotates, the indicator 206 also rotates; the position of the indicator 206 can thus be compared with the indicia on the housing face 202 to determine the location of the cam member 184. The operator can thus determine the location of the cam member 184, and thus the amount of fuel to be injected by the fuel pump system 120, by comparing the location of the indicator 206 with the indicia 204.

Figure 10:
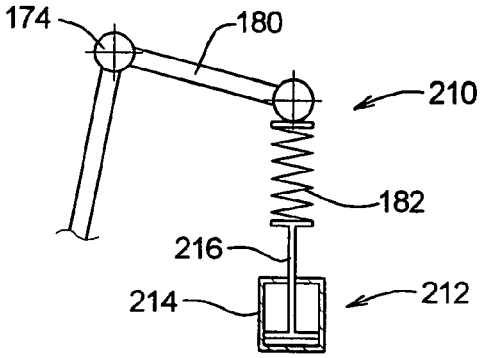
FIG. 10 PRIOR ART
FIG. 10 is a part sectional/part schematic view depicting yet another prior art variable fuel pump system.

Referring now to FIG. 10, depicted at 210 therein is a modification to the variable fuel pump system 120 described above. The modification 210 eliminates the cam member 184, cam roller 186, control pulley 188, and control rope 190 of the travel limiting assembly 128 described above. Instead, the modification 210 comprises an actuator assembly 212 that is connected to the link arm 180 through the link spring 182. The actuator assembly 212 comprises a fixed housing 214 and a shaft member 216. The actuator assembly 212 is operated to extend the shaft member 216 out of or retract the shaft member 216 into the housing 214. Operation of the actuator assembly 212 thus can change the effective volume of fuel pump chamber 150. However, the operator on the ground is provided with no visual feedback indicating the volume of the fuel pump chamber 150. Accordingly, while some commercial diesel hammers incorporate the modification 210, this modification 210 has thus not been generally adopted for use on variable fuel pump systems for diesel hammers.

II. Remote Controlled Variable Fuel Pump

Referring now to FIGS. 4–8; depicted at 220 therein is a variable fuel pump system constructed in accordance with, and embodying, the principles of the present invention. The variable fuel pump system 220 may be used as the fuel pump system 38 described above.

The fuel pump system 220 comprises a source 222 of fuel, a fuel pump cylinder assembly 224, a fuel pump lever 226, and a travel limiting assembly 228. The pump lever 126 is used as the pump lever 70 described above. The fuel pump cylinder assembly 224 comprises a fuel pump housing 230, a piston 232, and a pump spring 234. The fuel pump housing 230 defines a longitudinal axis B. The piston 232 comprises a piston head 240 and a piston shaft 242. The axis of the piston shaft 242 is aligned with the housing axis B such that the piston 232 moves along the housing axis B.

The fuel pump housing 230 defines a fuel pump chamber 250, and the piston head 240 divides the fuel pump chamber 250 into a fuel portion 252 and a reserve portion 254. A seal (not shown) prevents the flow of fluid between the fuel portion 252 and reserve portion 254.

The fuel source 222 is connected through a first conduit 260 to the fuel portion 252 of the fuel pump chamber 250. A first check valve 262 arranged in the first conduit 260 allows fluid to flow only from the source 222 to the fuel pump chamber 250. The fuel portion 252 of the fuel pump chamber 250 is also connected by a second conduit 264 to the fuel port 60 in the housing member 34. A second check valve 266 arranged in the second conduit 264 allows fluid to flow only from the fuel pump chamber 250 to the fuel port 60.

A spring landing 270 is formed on the fuel pump housing 230, and a spring retainer 272 is formed on the piston shaft 242. The pump spring 234 is a compression spring arranged between the spring landing 270 and the spring retainer 272. The pump spring 234 thus biases the spring retainer 272 away from the spring landing 270.

The fuel pump lever 226 is pivotably connected at one end to a pivot point 274 on the housing member 34. The pump lever 226 thus rotates between the ready (FIGS. 2 and 3) and pump (FIG. 3) positions relative to the housing member 34. The other end of the fuel pump lever 226 held against the piston shaft 242 by the travel limiting assembly 228 as will be described in detail below.

Accordingly, rotational movement of the fuel pump lever 226 about the pivot point 274 is translated into displacement of the piston 232 along the housing axis B. In particular, clockwise rotation of the fuel pump lever 226 causes the pump head 240 to move within the pump chamber 250 to decrease the volume of the fuel portion 252 thereof, while counter-clockwise rotation of the fuel pump lever 226 allows the pump spring 234 to move the pump head 240 in the opposite direction, thereby increasing the volume of the fuel portion 252 of the pump chamber 250. The pump spring 234 thus assists movement of the fuel pump lever 226 in the clockwise direction and opposes movement of the fuel pump lever 226 in the counter-clockwise direction.

A comparison of FIGS. 2 and 3 shows that the descending ram member 30 engages the pump lever 226 to rotate this lever in the counter-clockwise direction against the force of the pump spring 234. As shown in FIG. 2, the descending ram member 30 thus indirectly forces any fluid within the fuel portion 252 of the pump chamber 250 out of the pump chamber 250 and into the combustion chamber 40 through the fuel port 60.

Further, as shown in FIG. 3, when the ram member 30 moves above the pump lever 226, the pump lever 226 returns to the ready position under the force of the pump spring 234. The movement of the piston head 240 as the pump lever 234 returns to the ready position draws fuel from the fuel source 222 to refill the fuel portion 252 of the pump chamber 250.

The amount of fuel delivered by the variable fuel pump system 220 is determined by the volume of the fuel portion 252 of the pump chamber 250. The travel limiting assembly 228 is used to adjust the angular position of the pump lever 226 when the lever 226 is in the ready position. Because the pump lever 226 is connected to the piston 232 as described above, the travel limiting assembly 228 thus determines the volume of the fuel portion 252.

The travel limiting assembly 228 comprises a link arm 280, a link spring 282, a cam member 284, a cam roller 286, a control pinion 288, and a control rack assembly 290. The cam member 284 rotates about a cam axis C. The control pinion 288 is attached to the cam member 284 such that rotation of the pulley 288 causes rotation of the cam member 284 about the cam axis C. The control rack assembly 290 engages the control pinion 288 to cause the control pinion 288 to rotate, which in turn causes the cam member 284 to rotate about the cam axis C.

The cam member 284 is eccentric such that the distance between a cam surface 292 and the cam axis C varies from a first location 294 to a second location 296 on the cam surface 292. The cam roller 286 rides on the cam surface 292 such that the distance between the cam roller 286 and the cam axis C varies with angular rotation of the cam member 284. The cam axis C is fixed relative to the housing member 34; therefor, rotation of the cam member 284 causes the cam roller 286 to move relative to the housing member 34.

The link arm 280 is rigidly connected to the pump lever 226 such that the link arm 280 also rotates about the pivot point 274. The link arm 280 is arranged to apply a force on the cam roller 286 that holds the cam roller 286 against the cam surface 292, with the link spring 282 in compression between the link arm 280 and the cam roller 286.

A comparison of FIGS. 2 and 4 shows that the angular orientation of the cam member 284 determines the angular location of the pump lever 226. With the cam member 284 in a first angular orientation as shown in FIG. 2, the cam roller 286 engages the first location 294 on the cam surface 292. With the cam member 284 in a second angular orientation as shown in FIG. 4, the cam roller 286 engages the second location 296 on the cam surface 292.

The cam roller 286 in turn acts through the link spring 282 and link arm 280 to place the pump lever 226 in a first angular location (FIG. 2) or a second angular location (FIG. 4). As described above, the angular location of the pump lever 226 determines the location of the piston head 242 within the pump chamber 250 and thus the volume of the fuel portion 252 thereof.

The angular position of the cam member 284 thus determines the volume of the fuel portion 252 of the pump chamber 250 when the pump lever 226 is in the ready position; this relationship can be seen by comparing FIGS. 2 and 4.

The control rack assembly 290 comprises a control rack 320 and a control cylinder assembly 322.

The control cylinder assembly 322 comprises a control cylinder housing 330 and a control piston 332 having a control piston head 334 and a control piston shaft 336. The control piston head 334 is arranged within the cylinder housing 330 to divide a control chamber 338 defined by the housing 330 into first and second portions 340 and 342. The application of hydraulic fluid to one or both of the control chamber portions 340 and 342 causes linear displacement of the control rack 320 along a path D.

The control rack 320 comprises a toothed surface portion 344, and the control pinion 288 comprises a toothed surface portion 346. The teeth on the surface portions 344 and 346 are designed to mate with each other. In addition, the control rack 320 is supported adjacent to the control pinion 288 such that these surfaces portions 340 and 342 engage each other. Accordingly, linear displacement of the control rack 320 along the path D causes rotation of the control pinion 288 about the cam axis C. Because the control pinion 288 is attached to the cam member 284, the rotation of the control pinion 288 causes rotation of the cam member 284.

Figure 5:
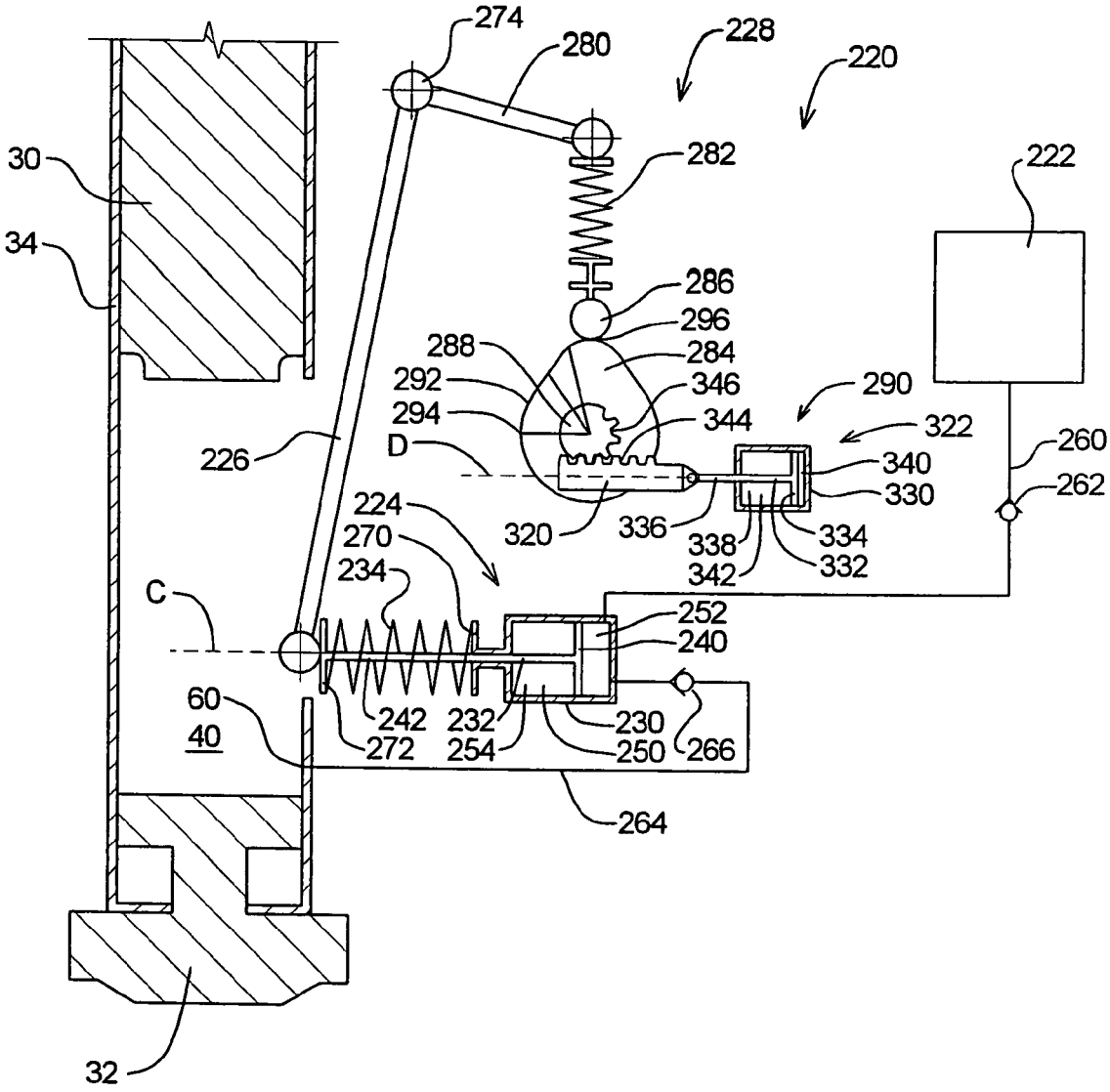
FIGS. 5 and 6 are part sectional/part schematic views depicting the operation of a variable fuel pump constructed in accordance with the principles of the present invention.
Figure 6:
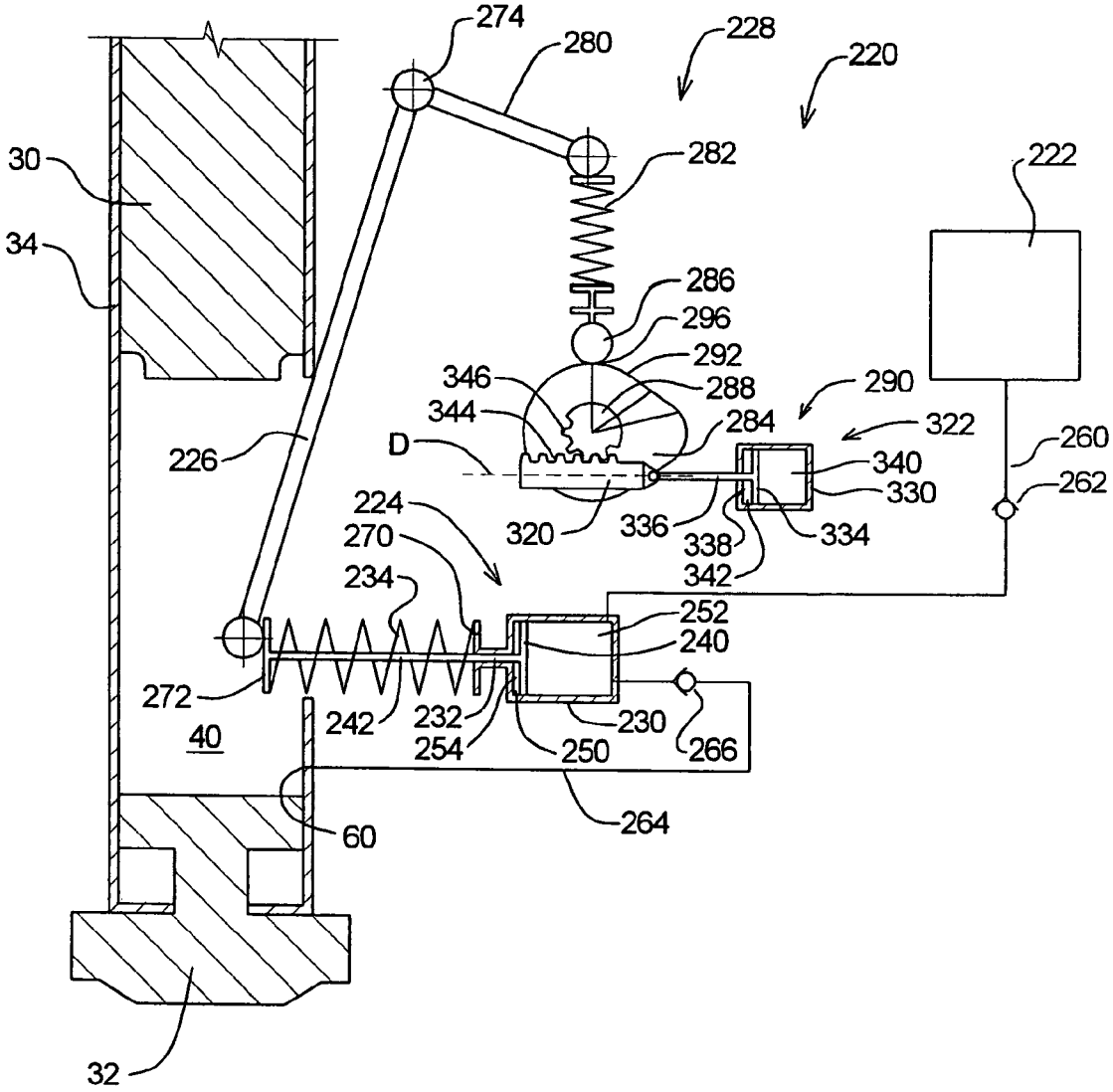

Accordingly, the travel limiting assembly 228 allows the volume of the fuel portion 252 of the pump chamber 250 to be changed remotely by the appropriate application of hydraulic fluid to the cylinder assembly 322. A comparison of FIGS. 5 and 6 illustrates that the location of the control piston 332 corresponds to different volumes of the pump chamber fuel portion 252.

Figure 7:
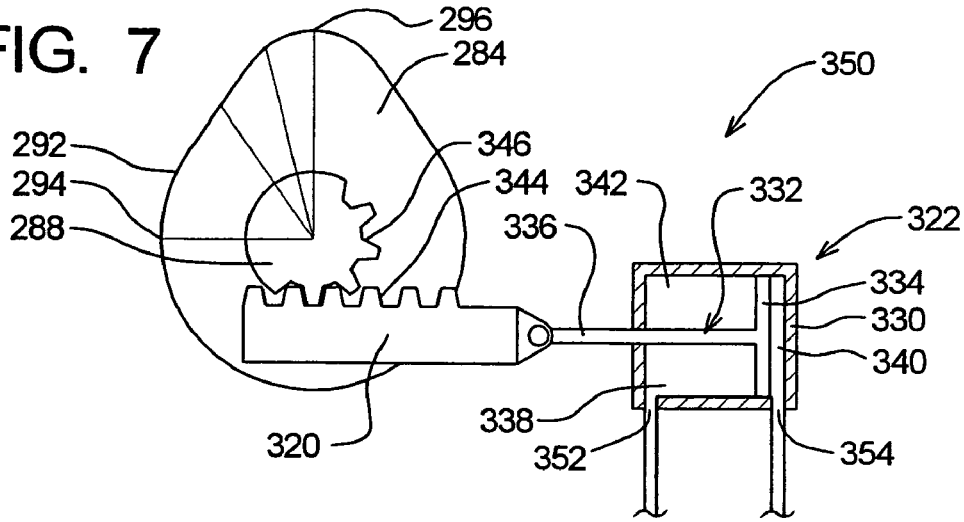
FIGS. 7–9 are part sectional/part schematic views depicting the operation of exemplary control systems used by the variable fuel pump of FIGS. 5 and 6.

Referring now to FIG. 7, depicted at 350 therein is a first embodiment of a control cylinder assembly that may be used as the control cylinder assembly 322 of the travel limiting assembly 228 of the present invention.

The control cylinder assembly 350 comprises first and second ports 352 and 354 that allow hydraulic fluid to be introduced into the first and second control chamber portions 340 and 342, respectively. In particular, introducing fluid into the first control chamber portion 340 while allowing fluid to flow out of the second control chamber portion 342 causes the control piston 332 to move in a first direction along the axis D. Introducing fluid into the second control chamber portion 342 while allowing fluid to flow out of the first control chamber portion 340 causes the control piston 332 to move in a second (opposite) direction along the axis D. The conduits and hydraulic controls required to apply fluid to the first and second ports 352 and 354 are conventional and will not be described herein in detail.

Figure 8:
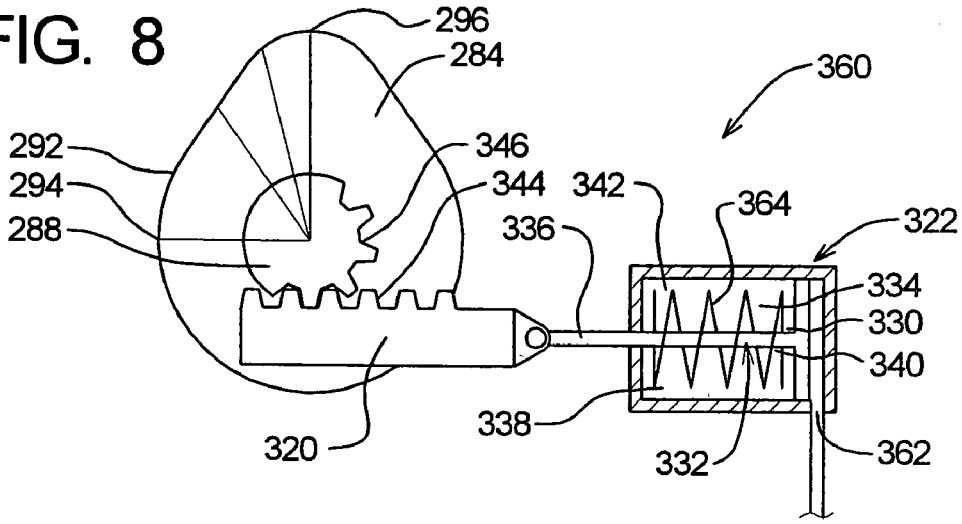

Referring now to FIG. 8, depicted at 360 therein is a second embodiment of a control cylinder assembly that may be used as the control cylinder assembly 322 of the travel limiting assembly 228 of the present invention.

The control cylinder assembly 360 comprises a port 362 that allows hydraulic fluid to be introduced into the first control chamber portion 340. In addition, a return spring 364 is arranged in the second control chamber portion 342 to oppose movement of the control piston 332 in a first direction along the axis D. Hydraulic fluid is introduced into the first control chamber portion 340 to cause the control piston 332 to move in the first direction along the axis D to a desired position. As long as a predetermined level of hydraulic pressure is maintained in the first control chamber portion 340, the control piston 332 will remain in the desired position. Releasing pressure within the first control chamber portion 340 allows the return spring 364 to move the control piston in a second (opposite) direction along the axis D. The conduits and hydraulic controls required to apply fluid to the first port 362 are conventional and will not be described herein in detail.

Figure 9:
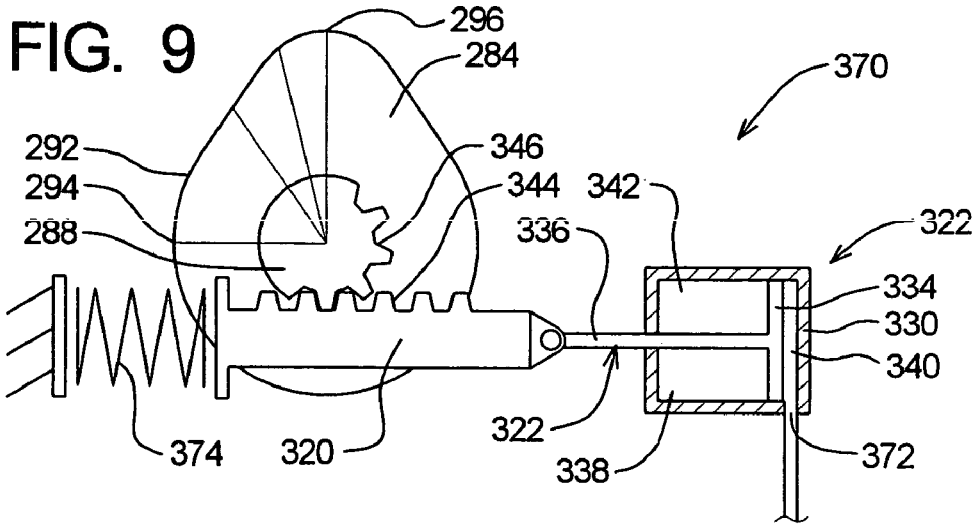

Referring now to FIG. 9, depicted at 370 therein is a second embodiment of a control cylinder assembly that may be used as the control cylinder assembly 322 of the travel limiting assembly 228 of the present invention.

The control cylinder assembly 370 comprises a port 372 that allows hydraulic fluid to be introduced into the first control chamber portion 340. In addition, a return spring 374 is arranged to engage the control rack 322 to oppose movement of the control piston 332 in a first direction along the axis D. Hydraulic fluid is introduced into the first control chamber portion 340 to cause the control piston 332 to move against the force of the spring 374 in the first direction along the axis D to a desired position. As long as a predetermined level of hydraulic pressure is maintained in the first control chamber portion 340, the control piston 332 will remain in the desired position. Releasing pressure within the first control chamber portion 340 allows the return spring 374 to move the control piston in a second (opposite) direction along the axis D. The conduits and hydraulic controls required to apply fluid to the first port 372 are conventional and will not be described herein in detail.

Figure 12:
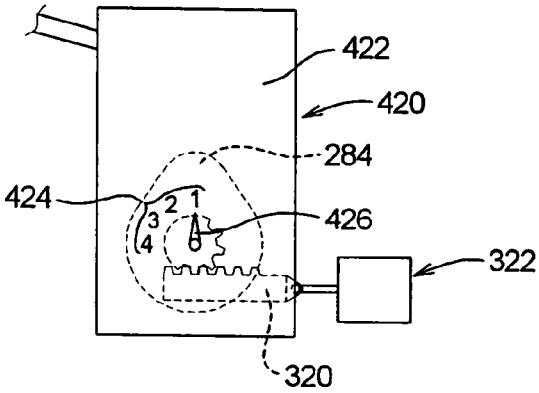
FIG. 12 is a somewhat schematic front elevation view of an exemplary housing that may be used with a fuel pump of the present invention.

In any of the control cylinder assemblies 350, 360, and 370, the hydraulic fluid may be applied to the control ports from a location remote from the location of the hammer system 20. For example, an operator of the crane or other equipment that supports the hammer system 20 may be provided with a lever or button that may be pulled or depressed to apply hydraulic fluid to these control ports as described above. The operator need not be physically adjacent to the hammer system 20 to vary the amount of fuel required, so the operator is more likely to adjust the fuel setting as required by a particular situation. Referring now to FIG. 12, depicted therein is a schematic view of an exemplary housing 420 that may be used to enclose the variable fuel pump system 220 described above. The housing 420 comprises a face 422 on which is formed indicia 424 corresponding to angular positions of the cam member 284. In one form of the invention, an indicator 426 is rigidly fixed in a predetermined relationship to the cam member 284. The indicator 426 is located outside of the housing 420. As the cam member 284 rotates, the indicator 426 also rotates; the position of the indicator 426 can thus be compared with the indicia on the housing face 422 to determine the location of the cam member 284. The operator can thus determine the location of the cam member 284, and thus the amount of fuel to be injected by the fuel pump system 220, by comparing the location of the indicator 426 with the indicia 424.

Referring now to FIG. 11, depicted therein is a schematic view of a housing 200 of the conventional variable fuel pump system 120 described above. The housing 200 has a face 202 on which are formed indicia 204 corresponding to angular positions of the cam member 184. An indicator 206 is rigidly fixed in a predetermined relationship to the cam member 184. The indicator 206 is located outside of the housing 200. As the cam member 184 rotates, the indicator 206 also rotates; the position of the indicator 206 can thus be compared with the indicia on the housing face 202 to determine the location of the cam member 184. The operator can thus determine the location of the cam member 184, and thus the amount of fuel to be injected by the fuel pump system 120, by comparing the location of the indicator 206 with the indicia 204.

III. Pre-trigger System

Referring now to FIGS. 13A–F, these figures illustrate that the diesel hammer system 20 conventionally comprises a line 430 from which is suspended a coupling assembly 432. The coupling assembly 432 is detachably attached to an upper end of the ram member 30. Accordingly, lifting the line 430 lifts the ram member 30. In addition, the coupling assembly 434 conventionally comprises a trigger member 434 that, when properly displaced, detaches the coupling assembly 432 from the ram member 30. The coupling assembly 432 comprises a trigger projection 436 that extends from the housing member 34 to engage the trigger member 434 and release the ram member 30 from the coupling assembly 434. The coupling assembly 432 is conventional and will not be described herein in detail.

Conventionally, the trigger projection 436 is located to engage the trigger member 434 and cause the coupling assembly 434 to release the ram member 30 after the ram member 30 has disengaged from the pump lever 70 and allowed the pump lever 70 to return to its ready position. In this case, the location of the trigger projection 436 ensures that fuel is injected into the fuel chamber 40 each time the line 430 is raised and the ram member 30 dropped.

In some situations, however, it is desirable to use the diesel hammer system 20 in a mode in which energy is applied to the pile 22 solely from the weight of the ram member 30 and not from the ignition of the fuel in the combustion chamber 40.

Figures 13A, 13B, 13C:
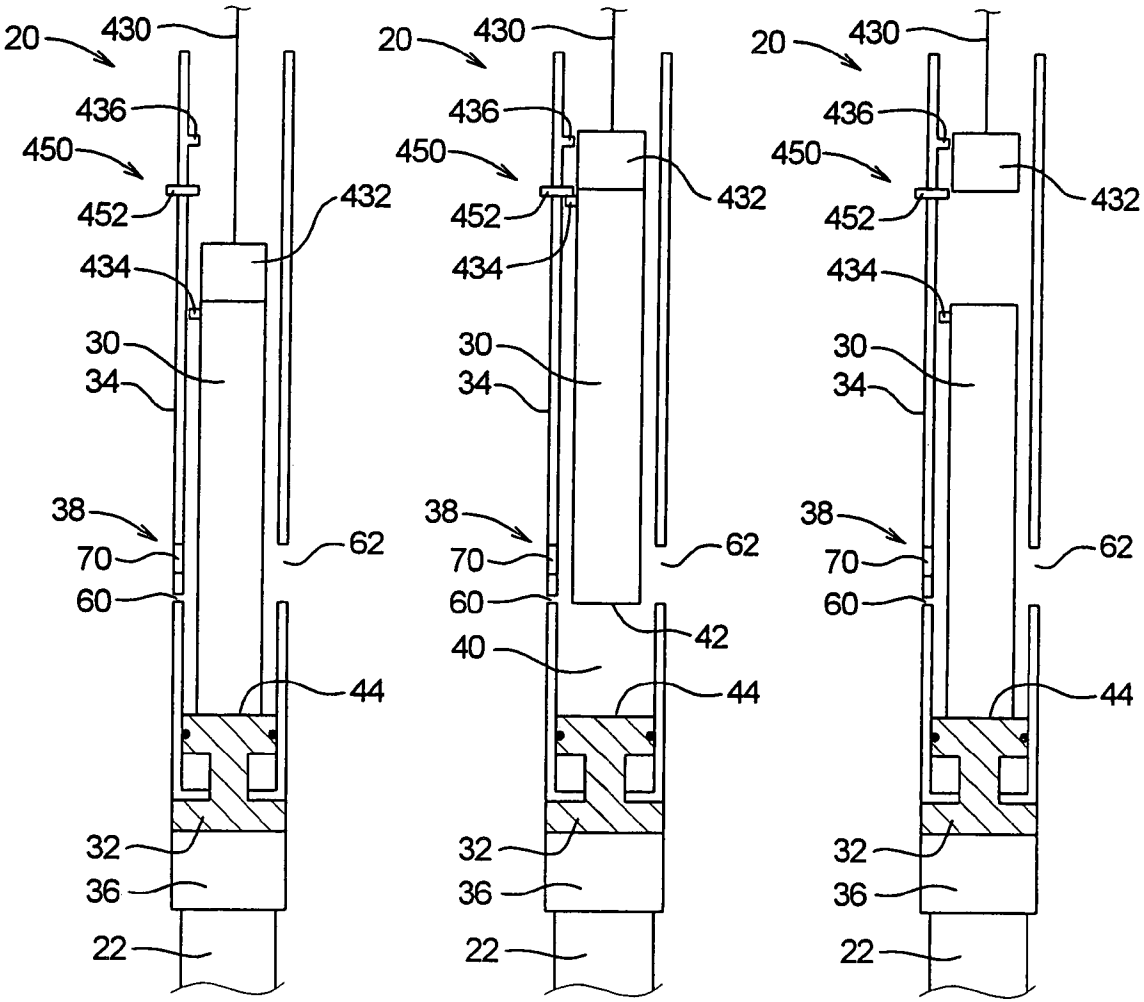
FIGS. 13A–F are somewhat schematic section views of yet another exemplary diesel hammer of the present invention.

As shown in FIGS. 13A–F, the diesel hammer system 20 depicted therein comprises a pre-trigger system 450 that allows the diesel hammer system 20 to operate in a conventional ignition mode and in a ram mode. The pre-trigger system 450 comprises a pre-trigger member 452 mounted on the housing member 34. The pre-trigger member 452 is movable relative to the housing member 34 between a retracted position (FIGS. 13D–F) and an extended position (FIGS. 13A–C).

Figures 13D, 13E, 13F:
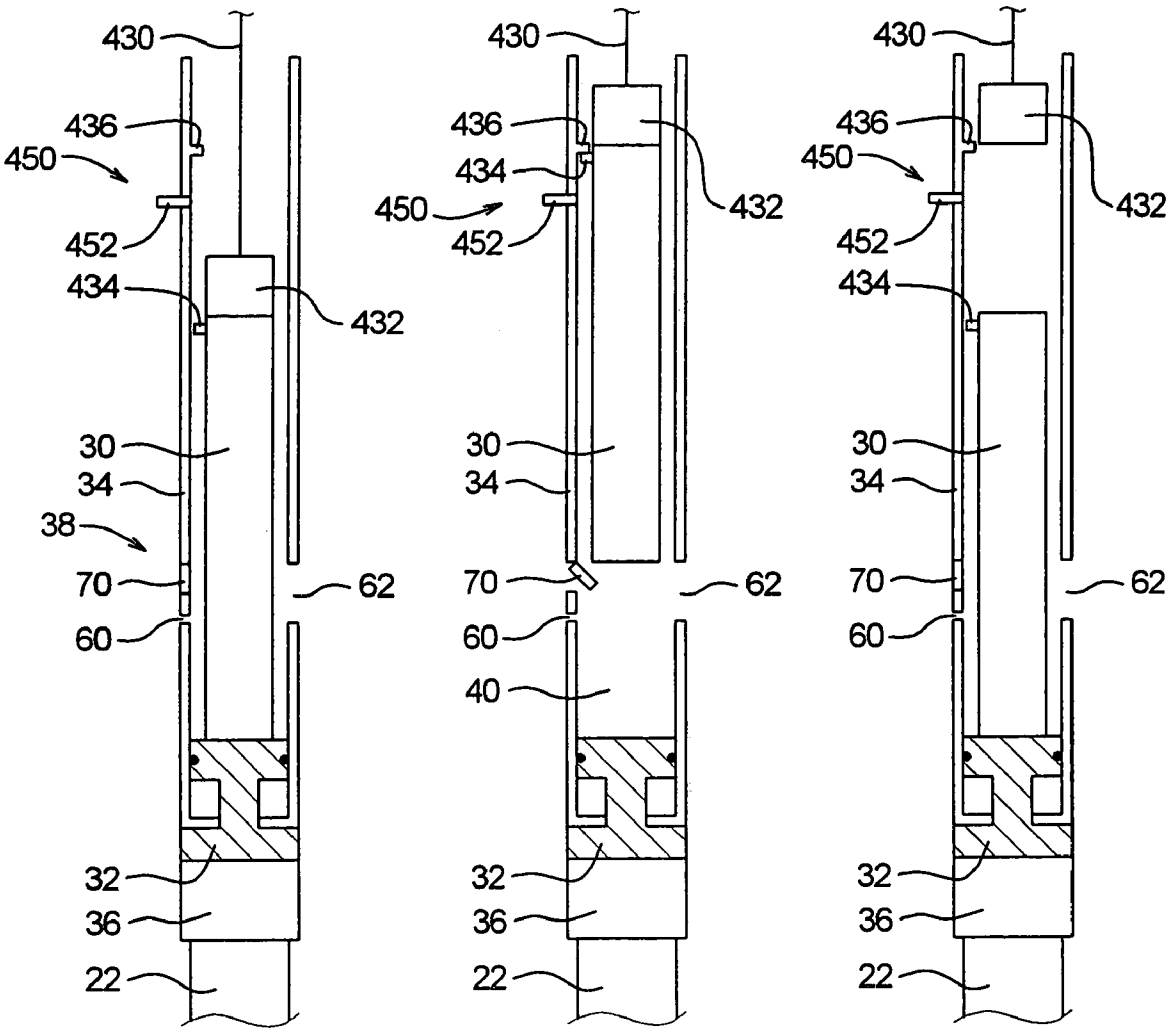

When the pre-trigger member 452 is in the retracted position, the diesel hammer system 20 incorporating the pre-trigger system 450 operates in a conventional ignition mode. As shown in FIG. 13D, the ram member 30 starts in the impact state; the ram member 30 is subsequently raised to an upper position as shown in FIG. 13E in which the pump lever 70 is in the ready position. Then, as shown in FIG. 13F, the trigger projection 436 engages the trigger member 434 to cause the coupling assembly 434 to release the ram member 30, thereby allowing the ram member 30 to drop back into the impact position. Fuel is injected into the fuel chamber 40 when the ram member 30 engages the pump lever 70 as the ram member 30 moves towards into the impact position. In the ignition mode, both the impact of the ram member 30 and the ignition of the fuel drive the anvil member 32.

When the pre-trigger member 452 is in the extended position as shown in FIGS. 13A–C, the pre-trigger member 452 engages the trigger member 434 before the trigger member 434 reaches the trigger projection 436. More specifically, the pre-trigger member 452 is arranged such that, as shown in FIG. 13B, the pre-trigger member 452 engages the trigger member 434 to release ram member 30 before the pump lever 70 has a chance to move into the ready position. Because the pump lever 70 never reaches the ready position, no fuel is injected into the combustion chamber before the ram member 30 strikes the anvil member 32 as shown at FIG. 13C. Accordingly, when the pre-trigger member 452 is in the extended position, the forces applied to the anvil member 32 are primarily due to the weight of the ram member 30 and not to the combustion of fuel within the combustion chamber 40.

The pre-trigger member 452 may be hand operated or, more conveniently, may be remotely operated by a hydraulic, pneumatic, or electrical actuator.

A diesel hammer system incorporating the pre-trigger system 450 may thus operate as a diesel hammer and as a conventional drop hammer. The user of such a diesel hammer system thus has more options when driving the piles 22 than with either a conventional diesel hammer system or a conventional drop hammer system.

Figure 14:
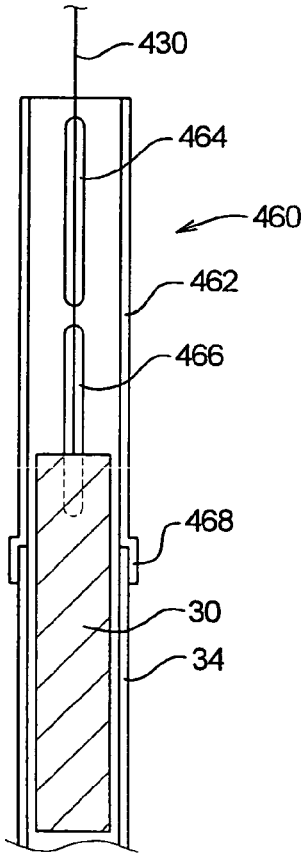
FIG. 14 is a somewhat schematic section view of still another exemplary diesel hammer of the present invention.

Referring now to FIG. 14, depicted at 460 therein is a housing extension member that may be used in connection with the diesel hammer system 20 described above. The housing extension member 460 extends from the housing member 34 of the system 20. The ram member 30 extends at least partly into the extension member 460 when the ram member 30 is in its upper position. The extension member 460 inhibits entry of dirt and other debris into the housing 34. Preferably, one or more slots such as slots 464 and 466 are formed in the extension member 460 to allow the user on the ground to see the travel of the ram member 34 as it is raised and lowered.

From the foregoing, it should be clear that the present invention may be embodied in forms other than those described above. The above-described systems are therefore to be considered in all respects illustrative and not restrictive, the scope of the invention being indicated by the appended claims rather than the foregoing description. All changes that come within the meaning and scope of the claims are intended to be embraced therein.

I claim:

1. A diesel hammer system for driving a pile, comprising:

a housing;

an anvil member supported by the housing;

a clamp assembly adapted to connect the anvil member to the pile;

a ram member disposed within the housing;

a fuel pump system for injecting fuel into a combustion chamber defined by the housing, anvil member, and the ram member; and a coupling system that detachably engages the ram member to raise the ram member from an impact position to an upper position, the coupling system comprising a trigger member that, when engaged, causes the coupling system to release the ram member;

a trigger projection mounted on the housing to engage the trigger member to cause the coupling system to release the ram member at the upper position; and a pre-trigger system comprising:

a pre-trigger member movable between an extended position and a retracted position; wherein when the pre-trigger member is in the extended position, the pre-trigger member engages the trigger member as the ram member moves from the impact position towards the upper position to cause the coupling system to release the ram member at a pre-trigger position; and when the pre-trigger member is in the retracted position, the pre-trigger member does not engage the trigger member as the ram member moves from the impact position to the upper position; whereby when the pre-trigger member is in the retracted position, the ram member moves from the impact position to the upper position and back to the impact position such that the ram member engages a fuel pump system to cause fuel to flow into the combustion chamber;

when the pre-trigger member is in the extended position, movement of the ram member from the impact position to the pre-trigger position and back to the impact position does not cause fuel to be forced out of the fuel chamber and into the combustion chamber.

2. A diesel hammer system as recited in claim 1, further comprising an extension member engaged with the housing member, where the ram member is disposed at least partly within the extension member when the ram member is in the upper position.

3. A diesel hammer system as recited in claim 1, in which at least one opening is formed in the extension member to allow a position of the ram member within the extension member to be seen from outside of the extension member.

4. A diesel hammer system as recited in claim 1, in which the fuel pump system further comprises:

a pump housing defining a fuel chamber, a pump piston disposed partly within the fuel chamber, a pump lever that engages the pump piston, a cam member, where an angular position of the cam member acts on the pump lever to determine a position of the pump piston within the fuel chamber and thus determine an effective volume of the fuel chamber;

an actuator assembly arranged to change the angular position of the cam member; whereby a fuel pump housing on which indicia are formed; and an indicator fixed relative to the cam member; wherein the indicator extends out of the fuel pump housing adjacent to the indicia to indicate the effective volume of the fuel chamber.

5. A diesel hammer system for driving a pile, comprising:

a housing;

an anvil member supported by the housing for movement relative to the housing between rest and impact positions;

a clamp assembly adapted to connect the anvil member to the pile;

a ram member disposed within the housing;

a fuel pump system for injecting fuel into a combustion chamber defined by the housing, anvil member, and the ram member; and an extension member engaged with the housing member, where the ram member is disposed at least partly within the extension member when the ram member is in an upper position; whereby movement of the ram member from the upper position into an impact position causes the ram member to act on the fuel pump system to force fuel into the combustion chamber; and as the ram member reaches the impact position, the anvil member moves from the rest position to the impact position.

6. A diesel hammer system as recited in claim 5, in which the fuel pump system comprises:

a pump housing defining a fuel chamber, a pump piston disposed partly within the fuel chamber, a pump lever that engages the pump piston, a cam member, where an angular position of the cam member acts on the pump lever to determine a position of the pump piston within the fuel chamber and thus determine an effective volume of the fuel chamber; and an actuator assembly arranged to change the angular position of the cam member; whereby a fuel pump housing on which indicia are formed; and an indicator fixed relative to the cam member; wherein the indicator extends out of the fuel pump housing adjacent to the indicia to indicate the effective volume of the fuel chamber.

7. A diesel hammer system as recited in claim 5, further comprising a coupling system that detachably engages the ram member to raise the ram member from the impact position to the upper position, the coupling system comprising a trigger member that, when engaged, causes the coupling system to release the ram member;

a trigger projection mounted on the housing to engage the trigger member to cause the coupling system to release the ram member at the upper position; and a pre-trigger system comprising:

a pre-trigger member movable between an extended position and a retracted position; wherein when the pre-trigger member is in the extended position, the pre-trigger member engages the trigger member as the ram member moves from the impact position towards the upper position to cause the coupling system to release the ram member; and when the pre-trigger member is in the retracted position, the pre-trigger member does not engage the trigger member as the ram member moves from the impact position to the upper position.

8. A diesel hammer system as recited in claim 6, in which at least one opening is formed in the extension member to allow a position of the ram member within the extension member to be seen from outside of the extension member.

9. A diesel hammer system for driving a pile, comprising:

a housing;

an anvil member supported by the housing for movement between rest and impact positions;

a clamp assembly adapted to connect the anvil member to the pile;

a ram member disposed within the housing;

a fuel pump system for injecting fuel into a combustion chamber defined by the housing, anvil member, and the ram member; and an extension member engaged with the housing member, where the ram member is disposed at least partly within the extension member when the ram member is in an upper position; whereby a coupling system that detachably engages the ram member to raise the ram member from the impact position to the upper position, the coupling system comprising a trigger member that, when engaged, causes the coupling system to release the ram member;

a trigger projection mounted on the housing to engage the trigger member to cause the coupling system to release the ram member at the upper position; and a pre-trigger system comprising a pre-trigger member movable between an extended position and a retracted position; wherein movement of the ram member from the upper position into an impact position causes the ram member to act on the fuel pump system to force fuel into the combustion chamber;

when the pre-trigger member is in the extended position, the pre-trigger member engages the trigger member as the ram member moves from the impact position towards the upper position to cause the coupling system to release the ram member; and when the pre-trigger member is in the retracted position, the pre-trigger member does not engage the trigger member as the ram member moves from the impact position to the upper position.

10. A diesel hammer system for driving a pile, comprising:

a housing;

an anvil member supported by the housing for movement between rest and impact positions;

a clamp assembly adapted to connect the anvil member to the pile;

a ram member disposed within the housing;

a fuel pump system for injecting fuel into a combustion chamber defined by the housing, anvil member, and the ram member, the fuel pump system comprising a pump housing defining a fuel chamber, a pump piston disposed partly within the fuel chamber, a pump lever that engages the pump piston, a cam member, where an angular position of the cam member acts on the pump lever to determine a position of the pump piston within the fuel chamber and thus determine an effective volume of the fuel chamber; and an actuator assembly arranged to change the angular position of the cam member; whereby a fuel pump housing on which indicia are formed; and an indicator fixed relative to the cam member; and an extension member engaged with the housing member, where the ram member is disposed at least partly within the extension member when the ram member is in an upper position; wherein movement of the ram member from the upper position into an impact position causes the ram member to act on the fuel pump system to force fuel into the combustion chamber;

as the ram member reaches the impact position, the anvil member moves from the rest position to the impact position the indicator extends out of the fuel pump housing adjacent to the indicia to indicate the effective volume of the fuel chamber; and at least one opening is formed in the extension member to allow a position of the ram member within the extension member to be seen from outside of the extension member.

* * * * *